US006884107B1

(12) United States Patent
Kuan

(10) Patent No.: US 6,884,107 B1
(45) Date of Patent: Apr. 26, 2005

(54) CONNECTOR

(75) Inventor: Chi-Te Kuan, Shulin (TW)

(73) Assignee: L & K Precision Technology Co., Ltd., Taipei (TW)

( * ) Notice: Subject to any disclaimer, the term of this patent is extended or adjusted under 35 U.S.C. 154(b) by 0 days.

(21) Appl. No.: 10/895,055

(22) Filed: Jul. 21, 2004

(51) Int. Cl.[7] ..... H01R 11/20
(52) U.S. Cl. ..... 439/404; 439/607
(58) Field of Search ..... 439/404, 405, 439/406, 607, 435

(56) References Cited

U.S. PATENT DOCUMENTS 5,762,513 A * 6/1998 Stine ..... 439/358
5,766,033 A * 6/1998 Davis ..... 439/405
6,346,055 B1 * 2/2002 Rege ..... 473/409

* cited by examiner

*Primary Examiner*—Gary Paumen
*Assistant Examiner*—James R. Harvey
(74) *Attorney, Agent, or Firm*—Troxell Law Office, PLLC

(57) ABSTRACT

A connector for connecting with cables and mate with a plug connector includes a first housing and a second housing assembled together, and a plurality of conductive terminals received in the first housing. The first housing has a first insulator and a first shell shielding the first insulator. The second housing has a second insulator and a second shell shielding the second insulator. Each conductive terminal has a contact end and a pierce end. When the first housing and the second housing are assembled together, the pierce ends of the conductive terminals pierce ends of the cables for electrically connecting with the cables. A plurality of U-shaped anchors is longitudinally arranged on the first shell for sandwiching the pierced ends of the cables therebetween. A plurality of biasing projections is longitudinally formed along a front of the second insulator and cooperates, with the anchors to press the cables. Thus, the cables are prevented from disengaging from the connector, thereby achieving reliable communication and lengthened life-span.

9 Claims, 5 Drawing Sheets

CONNECTOR

BACKGROUND OF THE INVENTION

1. Field of the Invention

The present invention relates to a connector, and particularly to a connector which firmly connects with cables and mates with a plug connector and which has long life-span and reliable communication performance.

2. Related Art

A conventional connector, which is adapted to be assembled to cables and mate with a plug connector, comprises an insulative housing, a plurality of conductive terminals received in the insulative housing and a shell shielding the insulative housing. The insulative housing has a mating portion for mating with the plug connector and a connecting portion for connecting with the cables. The conductive terminals are received between the mating portion and the connecting portion for electrically connecting with ends of the cables and mating with terminals of the plug connector.

The conductive terminals of the conventional connector are usually soldered to the cables. However, the cables are required to move frequently to mate with other devices. Correspondingly the cables tend to disengage from the conductive terminals of the conventional connector, resulting in unreliable communication and shortened life-span.

SUMMARY OF THE INVENTION

Accordingly, an object of the present invention is to provide a connector which reliably connects with cables for stable communication performance and long life-span.

The connector comprises a first housing and a second housing assembled to each other. The first housing has a first insulator and a first shell shielding the first insulator. The first insulator transversely defines a plurality of passageways therethrough for receiving conductive terminals. An opening is longitudinally defined through a top of the first insulator. Latching grooves are respectively defined beside opposite ends of the opening. A plurality of U-shaped anchors is longitudinally arranged on the first shell and is spaced the same distance from each other for sandwiching the cables therebetween.

The second housing includes a rectangular second insulator received in the opening, and a second shell shielding the second insulator. A plurality of biasing projections is longitudinally formed along a front of the second insulator and cooperates with the anchors to press the cables. A plurality of engaging holes is defined in the second shell and is longitudinally spaced the same distance from each other for locking the anchors. The second shell has assembling arms respectively extending and bending from opposite sides thereof for engaging with the latching grooves.

DESCRIPTION OF THE PREFERRED EMBODIMENTS

Figure 1:
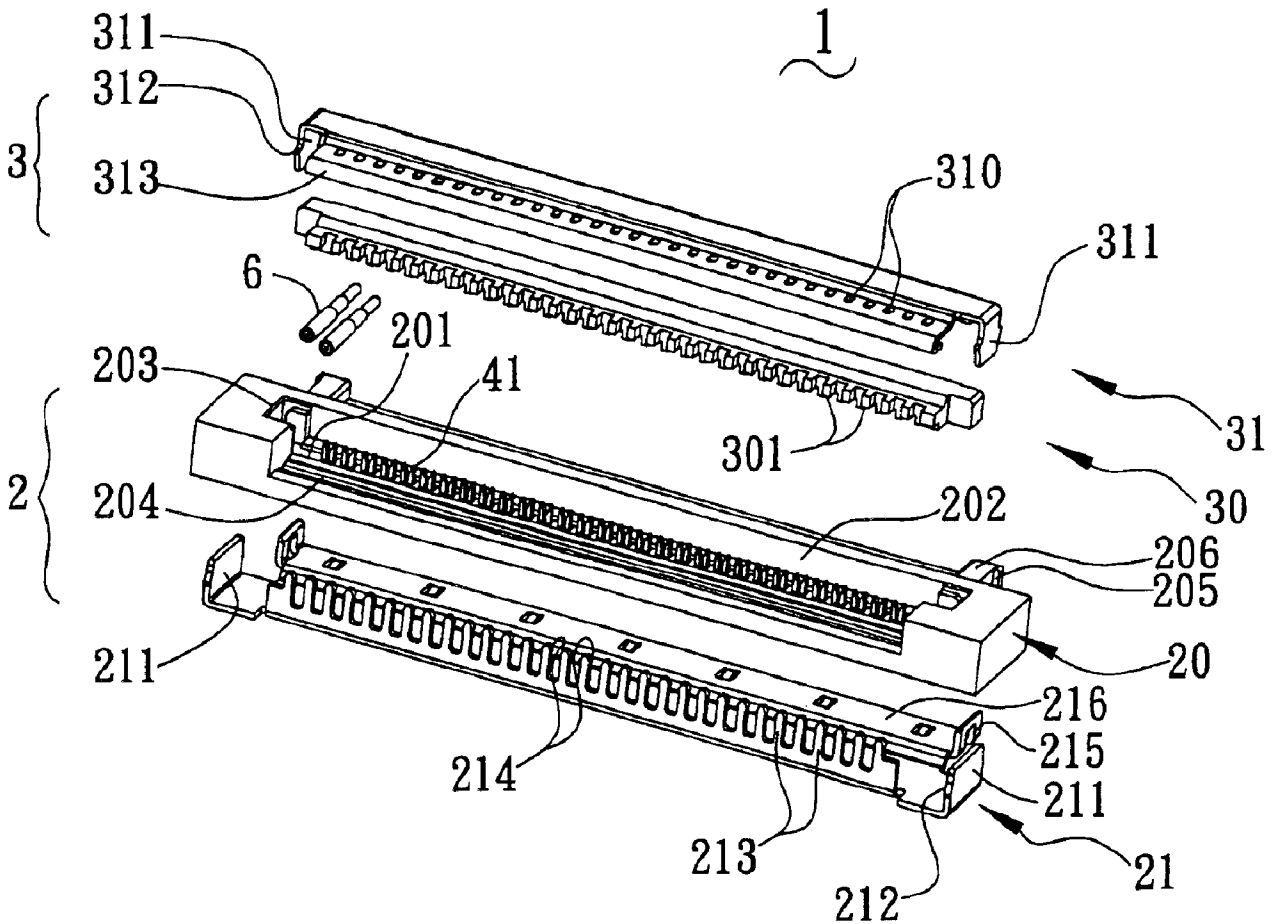
FIG. 1 is an exploded view of a connector in accordance with the present invention.

With reference to FIGS. 1 to 4, a connector 1 of the present invention comprises a first housing 2 and a second housing 3 assembled to each other.

The first housing 2 includes a first insulator 20 and a first shell 21 shielding the first insulator 20. The first insulator 20 is flat and rectangular and transversely defines a plurality of passageways 201 therethrough for receiving conductive terminals 4. Each conductive terminal 4 includes a contact end 40 at a rear end thereof for mating with a plug connector and a V-shaped pierce end 41 at a front end thereof for connecting with a cable 6. An opening 202 is longitudinally defined through a top of the first insulator 20. Latching grooves 203 are respectively defined beside opposite ends of the opening 202. A slot 204 is longitudinally defined in a lower portion of the first insulator 20 and communicates with the opening 202. A pair of locking blocks 206 extends from a rear of the first insulator 20 and respectively forms a plurality of protrusions 205 at outward sides thereof. The first shell 21 has connecting arms 211 respectively extending and bending from opposite sides thereof. The connecting arms 211 form first barbs 212 at opposite edges thereof for interferentially engaging with the first insulator 20. A plurality of U-shaped anchors 213 is longitudinally arranged between the connecting arms 211 and is spaced the same distance from each other for sandwiching the cables 6 therebetween. The distance between the anchors 213 is slightly smaller than the diameter of the cables 6 for retaining the cables 6 firmly. Inclined surfaces 214 are formed at opposing sides of a top edge of each anchor 213 for guiding the cables 6. The first shell 21 has a latching plate 216 at a rear thereof for enclosing a rear portion of the first insulator 20. A plurality of locking holes 215 is defined in opposite sides of the latching plate 216 for cooperating with the protrusions 205 of the first insulator 20.

The second housing 3 includes a rectangular second insulator 30 and a second shell 31 shielding the second insulator 30. A plurality of biasing projections 301 is longitudinally formed along a front of the second insulator 30 and cooperates with the anchors 213 to press the cables 6. A plurality of engaging holes 310 is defined in the second shell 31 and is longitudinally spaced the same distance from each other for locking the anchors 213. The width of the engaging holes 310 is slightly smaller than the width of the anchors 213. The second shell 31 has assembling arms 311 respectively extending and bending from opposite sides thereof. The assembling arms 311 form second barbs 312 at opposite edges thereof for interferentially engaging with the latching grooves 203 of the first insulator 20. A pressing plate 313 transversely extends from a front of the second shell 31 for pressing the cables 6 reliably.

Figure 2:
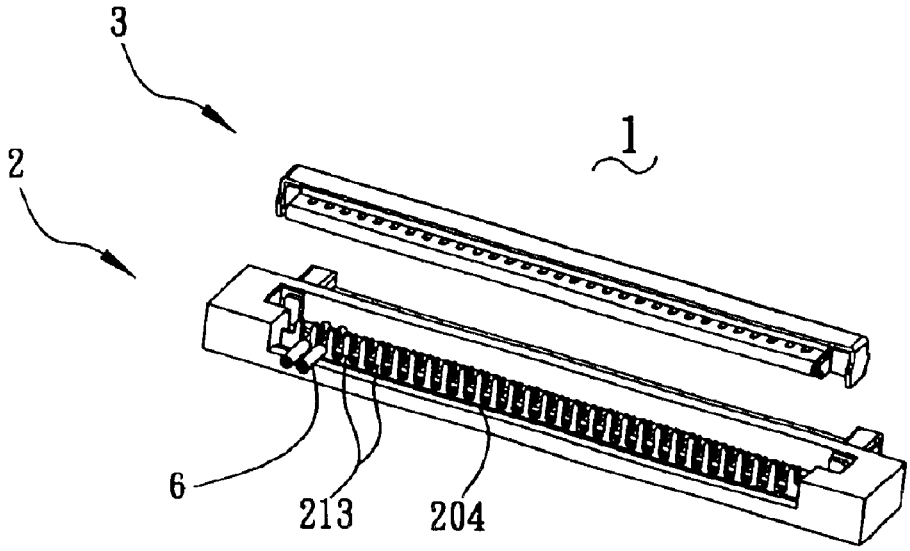
FIG. 2 is an assembled view of the connector of FIG. 1, wherein a first housing and a second housing of the connector are disengaged from each other.
Figure 3:
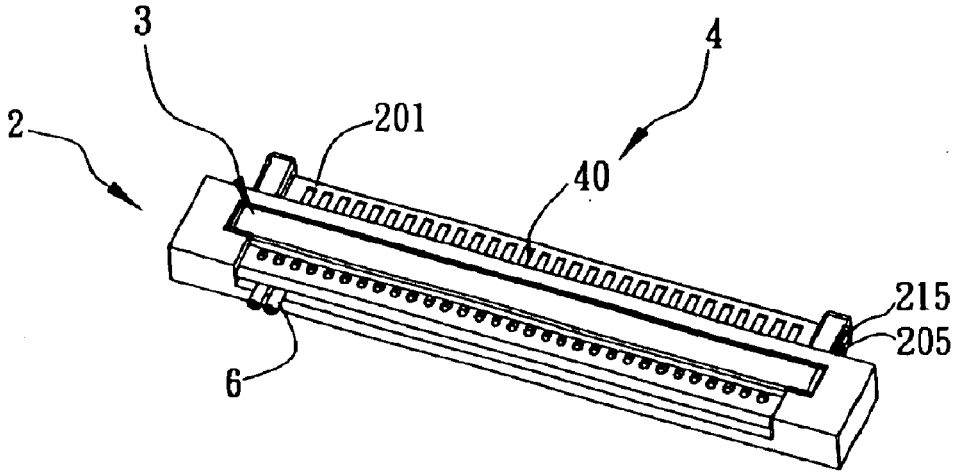
FIG. 3 is an assembled view of the connector of FIG. 1.
Figure 4:
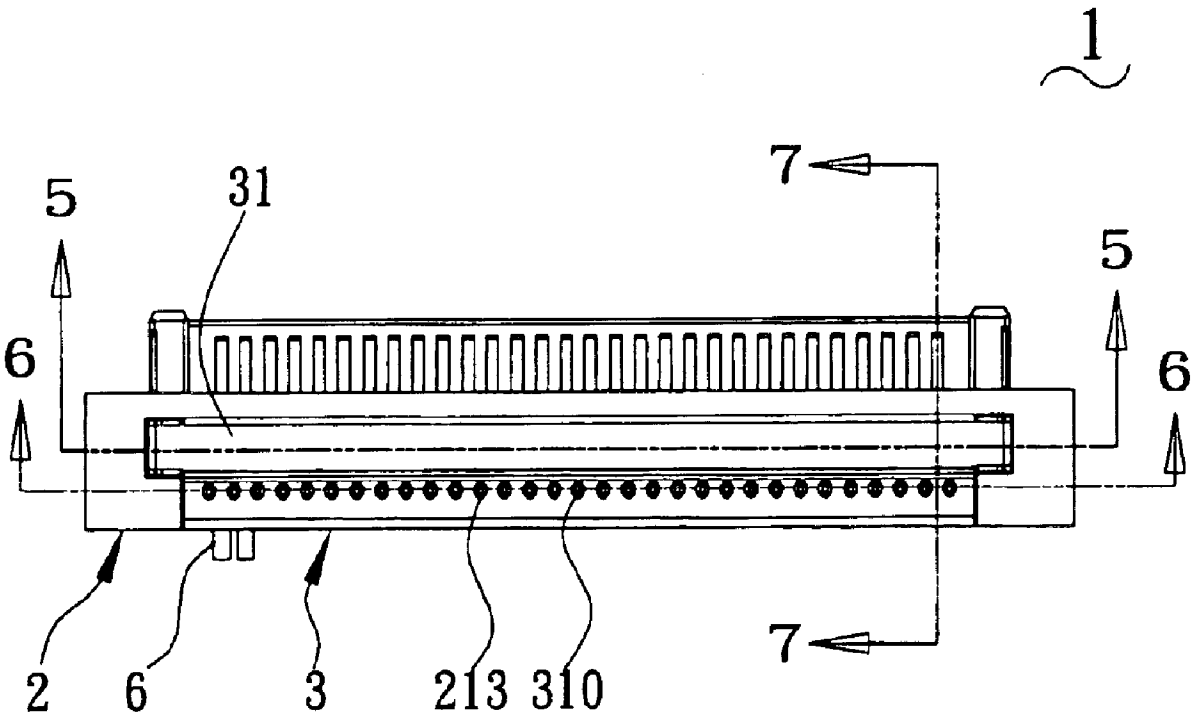
FIG. 4 is top view of the connector of FIG. 3.
Figure 6:
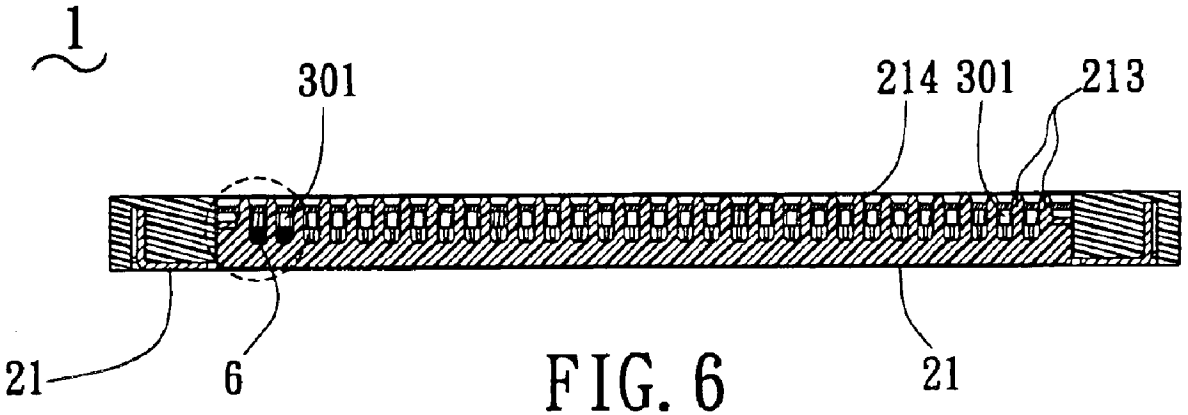
FIG. 6 is a cross-sectional view taken along the line 6—6 in FIG. 4.
Figure 5:
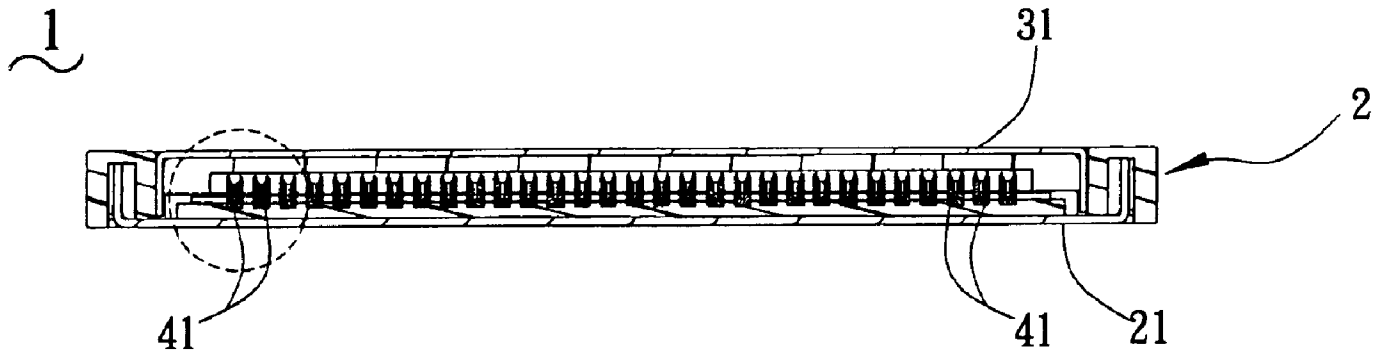
FIG. 5 is a cross-sectional view taken along the line 5—5 in FIG. 4.
Figure 7:
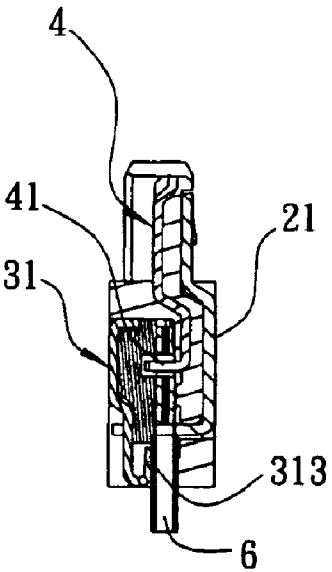
FIG. 7 is a cross-sectional view taken along the line 7—7 in FIG. 4.
Figure 6A:
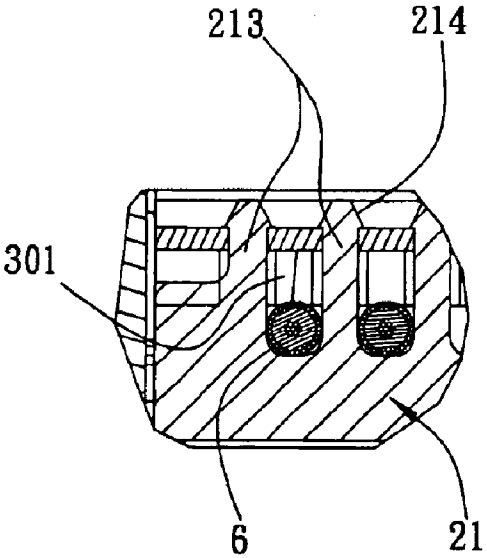
FIG. 6A is a partially enlarged view of FIG. 6.
Figure 5A:
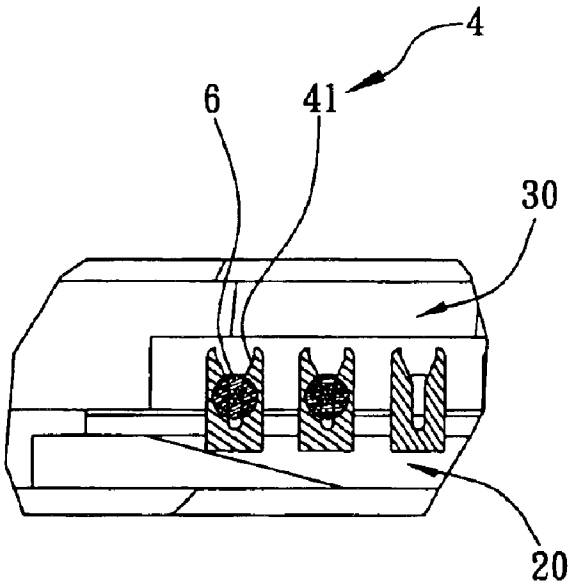
FIG. 5A is a partially enlarged view of FIG. 5.

In assembly, the first housing 2 and the second housing 3 are assembled to each other. Referring to FIG. 2, the first shell 21 is assembled to the first insulator 20. The anchors 213 are mounted in the slot 204. Ends of the cables 6 are mounted on the pierce ends 41 of the conductive terminals 4 and are sandwiched between the anchors 213. Further referring to FIG. 3, the second insulator 30 and the second shell 31 are assembled together. The second insulator 30 is received in the opening 202 of the first insulator 20, and the assembling arms 311 engage with the latching grooves 203 of the first insulator 20. In combination with FIGS. 6 and 6A, the biasing projections 301 extend between the anchors 213 to press the cables 6. In combination with FIGS. 5 and 5A, the pierce ends 41 pierce ends of the cables 6 whereby the conductive terminals 4 electrically connect with the cables 6. Further referring to FIG. 7, the anchors 213 sandwich the pierced ends of the cables 6 therebetween. The biasing projections 301 and the pressing plate 313 press against the cables 6 at the same time. Thus, the pierced ends of the cables 6 are firmly retained in the connector 1 and effectively prevent from disengaging from the connector 1 when the cables 6 mate with other devices.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A connector, which is adapted to connect with cables and mate with a plug connector, comprising:

a first housing including a first insulator and a first shell for shielding the first insulator, the first insulator being flat and rectangular and defining a plurality of passageways therein, an opening being longitudinally defined through a top of the first insulator, latching grooves being respectively defined beside opposite ends of the opening, a slot being longitudinally defined in a lower portion of the first insulator and communicating with the opening, connecting arms respectively extending and bending from opposite sides of the first shell, a plurality of U-shaped anchors being formed between the connecting arms and mounted in the slot for latching the cables;

a second housing including a rectangular second insulator accommodated in the opening and a second shell shielding the second insulator, the second insulator forming a plurality of biasing projections longitudinally along a front thereof for pressing the cables, a plurality of engaging holes being defined in the second shell for locking the anchors, assembling arms respectively extending and bending from opposite sides of the second shell for engaging with the latching grooves of the first insulator; and a plurality of conductive terminals received in the passageways, and each conductive terminal having a contact end at a rear end thereof for mating with a plug connector and a pierce end at a front end thereof for piercing an end of a cable to electrically connect with the cable.

2. The connector as claimed in claim 1, wherein the connecting arms form first barbs at opposite edges thereof for interferentially engaging with the first insulator.

3. The connector as claimed in claim 1, wherein the anchors are U-shaped and are spaced the same distance from each other, and wherein the distance between the anchors is slightly smaller than the diameter of the cables for retaining the cables firmly.

4. The connector as claimed in claim 1, wherein inclined surfaces are formed at opposing sides of a top edge of each anchor for guiding the cables.

5. The connector as claimed in claim 1, wherein a latching plate is formed at a rear of the first shell for enclosing a rear portion of the first insulator, and defines a plurality of locking holes in opposite sides of the latching plate, and wherein a pair of locking blocks extends from a rear of the first insulator and respectively forms a plurality of protrusions at outward sides thereof for cooperating with the locking holes.

6. The connector as claimed in claim 1, wherein a pressing plate transversely extends from a front of the second shell for pressing the cables reliably.

7. The connector as claimed in claim 1, wherein the width of the engaging holes is slightly smaller than the width of the anchors.

8. The connector as claimed in claim 1, wherein the assembling arms form second barbs at opposite edges thereof for interferentially engaging with the latching grooves of the first insulator.

9. The connector as claimed in claim 1, wherein the pierce ends of the conductive terminals are V-shaped.

* * * * *